United States Patent [19]

Welker, III et al.

[11] 3,993,223

[45] Nov. 23, 1976

[54] DISPENSING CONTAINER

[75] Inventors: George W. Welker, III, Downingtown; Joseph E. Brady, West Chester, both of Pa.

[73] Assignee: American Home Products Corporation, New York, N.Y.

[22] Filed: July 25, 1974

[21] Appl. No.: 491,903

[52] U.S. Cl. ..... 222/107; 222/541; 206/498; 206/528

[51] Int. Cl.[2] ..... B65D 35/08

[58] Field of Search ..... 222/107, 541; 215/32, 215/253; 206/484, 498, 538, 528

[56] References Cited

UNITED STATES PATENTS

| | | | |
|---|---|---|---|
| 3,081,002 | 3/1963 | Tauschihski et al. | 222/541 X |
| 3,184,121 | 5/1965 | Volckening | 206/484 X |
| 3,297,207 | 1/1967 | Ballin | 222/107 |
| 3,353,714 | 11/1967 | Trecek | 222/107 |
| 3,356,244 | 12/1967 | Witchell | 215/32 |
| 3,862,684 | 1/1975 | Schmitt | 206/484 X |
| 3,913,734 | 10/1975 | Siegel | 206/484 X |

*Primary Examiner*—Allen N. Knowles
*Attorney, Agent, or Firm*—Joseph Martin Weigman

[57] ABSTRACT

A sealed dispensing container for liquid medicaments is described which may be readily opened by a twisting force applied on opposite ends of the container. All of the parts of the container making up a chamber for the medicament are shaped to be substantially completely flattened by the application of a compressive force, such as that applied by thumb and forefinger, to completely discharge the liquid medicament. After the container is opened, the liquid will be retained in the container in the absence of a compressive force and regardless of the orientation of the container in a horizontal or inverted position.

7 Claims, 8 Drawing Figures

FIG. 1
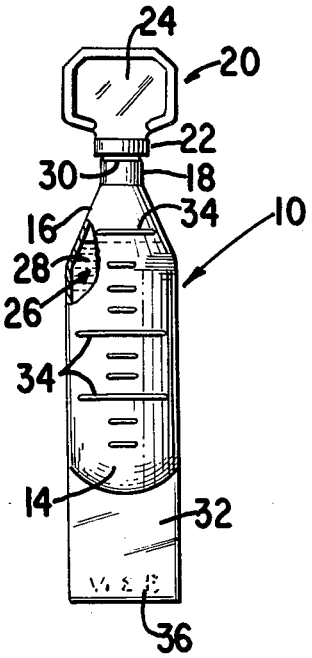
FIG. 2
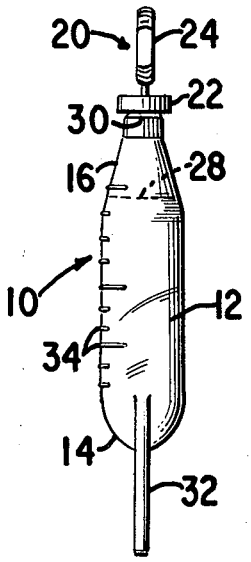
FIG. 4
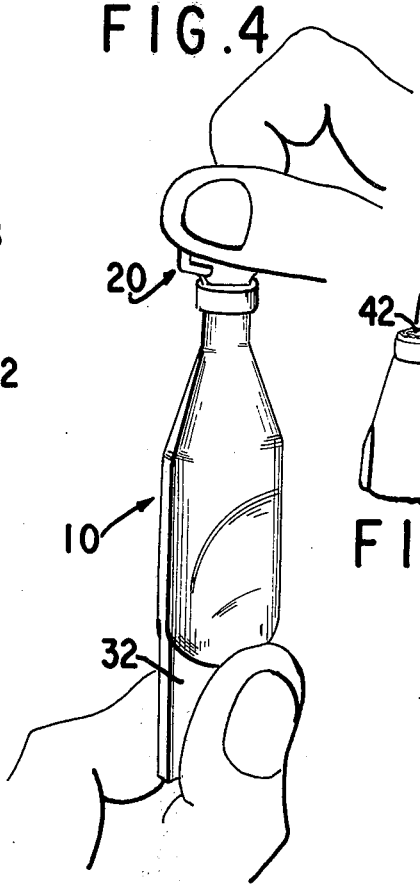
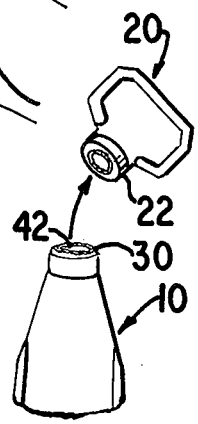
FIG. 5
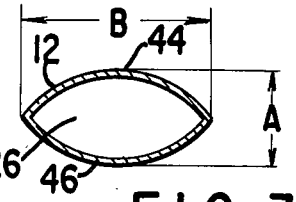
FIG. 3
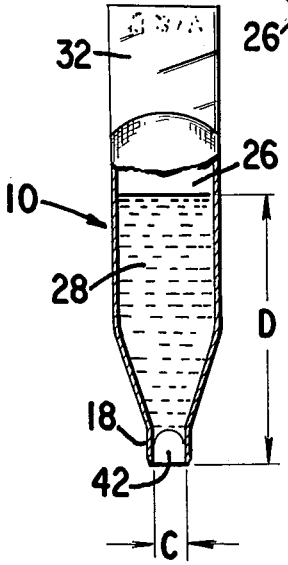
FIG. 6
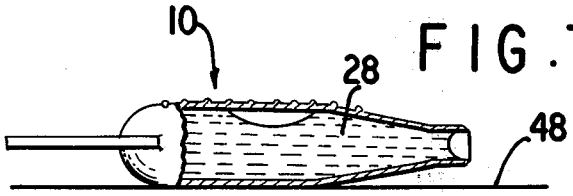
FIG. 7
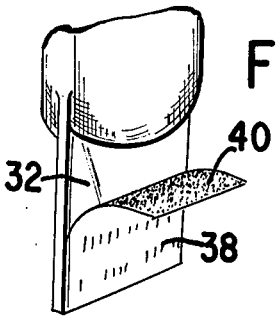
FIG. 8

DISPENSING CONTAINER

This invention is directed to dispensing containers, and more particularly is directed to dispensing containers for liquid medicaments. While the containers are adapted to any liquid or liquid medicament, they are especially useful in connection with respiratory therapy for the addition of medicaments into the commonly used inhalators. While the container is especially suited for complete discharge of the entire contents at one time, the container may, if desired, be calibrated so the measured portions of the contents may be discharged seriatim.

Traditional packaging for sterile medicaments involves combinations of glass, rubber, plastic and metallic components. All of which require sterilizaton and special handling prior to assembly and filling of the resulting package. Such components and their assembly constitute complex specification and fabrication of materials, machinery and environmental controls to insure adequacy of the final package. Step-by-step processing, filling, and assembly introduce significant potentials for contamination or a loss of product quality or both. Such characteristics frequently lead to high product cost and prevent the production of sterile medicaments except under the most stringent and expensive production conditions.

Through the utilization of the capabilities of the commercially available aseptic form, fill and seal systems such as machinery manufactured as described in U.S. Pat. No. 3,325,860, it is now commercially feasible to produce a one piece, aseptically filled, sealed, plastic container containing sterile liquid medicaments.

It is an object of the present invention to provide a low cost, self contained, disposable, hermetically sealed sterile, unit-of-use package for medical products such as those required in respiratory therapy or other applications for sterile liquid medicaments.

It is another object of the present invention to provide a sealed dispensing container for respiratory therapy liquids which may be readily opened by a twisting motion manually applied.

It is a further object of this invention to provide a dispensing container which after opening retains the contents regardless of the orientation of the container against the force of gravity and yet readily discharges the contents by the application of a compressive force.

Other and further objects of the invention will be apparent to those skilled in the art from reading the following description along with the drawings in which:

FIG. 1 is a front view, partly in section, of a preferred embodiment of the container of the present invention;

FIG. 2 is a side view of the container;

FIG. 3 is a cross-sectional view taken generally along line 3—3 of FIG. 1;

FIG. 4 is a perspective view showing the container grasped during the opening operation;

FIG. 5 is a detail view showing the container after opening;

FIG. 6 is a front view, partly in section, showing the container in an inverted position after opening;

FIG. 7 is a side view, partly in section, showing the container in a horizontal position after opening; and FIG. 8 is a detail view showing a label applied to the end of the container.

The objects of the present invention may be achieved with a dispensing container for a liquid medicament comprising an elongated curvilinear container which defines a sealed chamber to contain a liquid medicament and has a thinned section adjacent to a first end, a first tab connected to the first end adjacent to the thinned secton and a second tab connected to the container in a spaced-apart relation to the first tab.

The container design, in addition to functional convenience, incorporates several desirable features. The body itself with all surfaces curved is designed to empty readily without significant hold up. By utilizing the neck opening diameter, surface tension of liquids to be filled and the characteristics of the plastics used for the materials of construction of the container, a bottle is produced which retains liquid until squeezed and can be held in a horizontal or inverted position without dripping. That is, the neck opening, after removal of the break off tab, is specifically dimensioned in its diameter to allow retention of aqueous-based products until squeezed even when the package is positioned on its side or upside down.

All of the surfaces of the container body are contoured to allow the contents to be readily expelled without "hold-up" which contrasts to a prior art stand up squeeze bottle in which the contents will typically flow out by gravity should the bottle be inadvertently knocked over or inverted.

The container shoulders, that is the truncated conical portion, are specifically tapered to facilitate product expulsion and thus take the full advantage of the retention feature combined with easy discharge.

The tapered oval bottle configuration provides maximum surface for incorporation of engraved text or graduations into the mold. The break off tab in addition to providing the hermetic seal, provides for a firm grip and easy break off. The flat surface provides suitable area for the incorporation of engraved text, for instance of the corporate logo.

The bottom tab on the container serves as a location for molded control numbers and other variable data. The tab serves several functions. It provides a flat area for imprinting variable text by the use of changable inserts in the mold to provide for required pharmaceutical numbering such as batch or control number, expiration date, and the like. It also serves as a specifically designed gripping surface which prevents premature squeezing and expulsion of the fluid contents during the opening process. Additionally, the molded tab provides a flat surface receptive to standard labeling techniques should a separate lable, rather than a molded-in copy, be required.

By the use of a label bearing surface apart from the wall of the chamber containing the medicament, the container also avoids label adhesive migration to the fluid contents because at no point is the label directly opposite the contents through the container wall.

The thickness of the wall of the cylindrical portion determines the amount of torque necessary to shear the tab to open the container. The provision of a thin portion in the cylindrical portion provides a control point for shearing and locates the line of severance.

The truncated conical portion also provides a funnel effect to enable the exact control of the point of discharge. The conical portion also serves as a guide to the orifice of the port of an inhalator typically used for respiration therapy.

As may be seen in FIG. 1, a sealed dispensing container 10 of the present invention is made up of an elongated curvilinear middle portion 12, a hemi-ellipsoidal portion 14 closing one end of the middle portion 12, a truncated conical portion 16 which is connected at its larger end to the middle portion 12, and a substantially cylindrical portion 18 connected to the smaller end of the truncated conical portion 16. A first tab 20 made up of a disc 22 and a flat portion 24 is connected to the cylindrical portion 18 and serves as a closure for the container, thus defining a chamber 26 to contain a medicament 28. In an especially advantageous embodiment the end portion 30 of the cylindrical portion 18 adjacent the disc 22 is comprised of a thinned wall section and defines a shear line for removal of the tab 20.

A second tab 32 is connected to the hemi-ellipsoidal portion 14 at the end of the container opposite the first tab. In an alternate embodiment, not shown, the second tab may be connected to the side of the middle portion, if desired.

If desired, calibrating indicia 34 may be applied to the middle portion 12 and conical portion 16 to indicate the amount of medicament discharged as will be further described below.

Also, it is advantageous to apply indicia 36 to either or both of the first and second tabs 20, 32. Such indicia may be embossed directly on the tabs by appropriate preparation of the molds as is well known in the art.

Alternatively, a label 38 may be applied with an adhesive 40 to the second tab 32 as is shown in FIG. 8. The label is preferably paper and may be the same size as the tab but preferably is considerably larger than the tab to accommodate a large printable area.

As is shown in FIG. 4, the sealed container 10 may be opened by grasping the first and second tabs 20, 32 and rotating them in opposite directions. As may be seen in FIG. 5 the shearing force thus applied causes the tab 20 to be separated from the inner container 10 at the junction of the disc 22 and the end portion 30 of the cylindrical portion 18.

All of the portions 12, 14, 16 and 18 defining the chamber 26 are shaped so that by the application of a compressive force to them the chamber 26 may be substantially completely flattened permitting the complete discharge of the medicament 28 through the discharge orifice 42 defined by the end portion 30. The substantially complete flat collapsibility is accomplished by the utilization of a curvilinear middle portion 12 which is substantially elliptical in cross-section. As may be seen in FIG. 3 the width B of the container is substantially greater than the depth A of the container. The strength of the container may be aided by the opposed arched construction of the walls 44, 46. The compressive force is applied so as to reduce dimension A. In a preferred embodiment the compressive force manually applied by the thumb and forefinger is sufficient to discharge the contents.

The hemi-ellipsoidal configuration of portion 14 permits that portion of the container also to be substantially completely flattened by application of compressive force. The truncated conical section may be similarly flattened.

All of the contents may be discharged at one time or only a portion may be discharged by controlling the compressive force applied. The amount of the contents discharged at one time may be measured by reference to the calibrating indicia 34.

The preferred materials of construction of the container are pharmaceutically acceptable soft plastics. Such plastics include low density polyethylene, polypropylene, polystyrene and polyamides and also more rigid plastics, such as medium or high density polyethylene may be used by reducing the wall thickness correspondingly. The wall thickness of such soft plastics may be conveniently sized to provide a rugged container and yet permit the compression under force which is that typically applied by the thumb and forefinger of one hand.

Suprisingly, it has been found that in certain configurations the liquid medicament 28 is retained in the chamber 26 after opening, in the absence of the application of a compressive force, regardless of the orientation of the container. As is seen in FIG. 7 the container 10 may be laid on a flat surface 48 in a horizontal position without discharge of the medicament 28. As is shown in FIG. 6 the container 10 may be maintained in an inverted position with the discharge orifice 42 at the bottom without discharge of the medicament 28. Without wishing to be bound by a theory of operation, it is believed that there is a critical relationship between the size C of the orifice, the surface tension of the liquid medicament, and the material of construction of the container which results in attractive forces which are greater than the hydrostatic pressure of the head D of the liquid medicament even in the vertical position. A typical retention system occurs when C is 4 millimeters, D is 5 centimeters, the package is low density polyethylene, and the liquid is sterile water.

What is claimed is:

1. A sealed dispensing container for a liquid medicament comprising a unitary molded container including:
   - A. An elongated continuously curvilinear middle portion;
   - B. A hemi-ellipsoidal portion closing one end of said middle portion;
   - C. A truncated conical portion having its larger end connected to said middle portion opposite said hemi-ellipsoidal portion;
   - D. A substantially cylindrical portion connected to said truncated conical portion;
   - E. A first integral tab closing one end of said cylindrical portion;
   - F. A second integral tab connected to said hemi-ellipsoidal portion; whereby when said first and second tabs are rotated in opposite directions said cylindrical portion shears adjacent said first tab defining a discharge orifice.

2. A dispensing container as defined in claim 1 wherein said cylindrical portion further comprises a thinned wall section adjacent said first tab whereby shearing is facilitated.

3. A dispensing container as defined in claim 1 wherein the diameter of said cylindrical portion is about four millimeters and the liquid medicament is retained after said first tab is removed until a compressive force is applied to the container.

4. A dispensing container as defined in claim 1 in which said elongated curvilinear middle portion is comprised of opposed arches.

5. A dispensing container as defined in claim 1 in which said elongated curvilinear middle portion is substantially elliptical in cross-section.

6. A dispensing container as defined in claim 1 wherein the material of construction is soft plastic.

7. A dispensing container as defined in claim 1 wherein the material of construction is selected from the class consisting of low density polyethylene, polypropylene, polystyrene and polyamides.

* * * * *